US006953085B2

(12) United States Patent
Nice

(10) Patent No.: US 6,953,085 B2
(45) Date of Patent: Oct. 11, 2005

(54) WELL PRESSURE ACTIVATED PACK-OFF HEAD

(75) Inventor: Sidney Basil Nice, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 204 days.

(21) Appl. No.: 10/417,580

(22) Filed: Apr. 17, 2003

(65) Prior Publication Data

US 2004/0011519 A1 Jan. 22, 2004

Related U.S. Application Data

(62) Division of application No. 09/841,671, filed on Apr. 24, 2001, now Pat. No. 6,588,502

(60) Provisional application No. 60/251,292, filed on Dec. 5, 2000.

(51) Int. Cl.[7] ..... E21B 33/08

(52) U.S. Cl. ..... 166/84.4; 166/88.1; 277/330

(58) Field of Search ..... 106/84.4, 88.1, 106/151, 363, 364; 277/330

(56) References Cited

U.S. PATENT DOCUMENTS

| | | | | | |
|---|---|---|---|---|---|
| 3,228,703 | A | * | 1/1966 | Wilson | 277/330 |
| 3,265,399 | A | * | 8/1966 | Scaramucci | 277/330 |
| 3,606,347 | A | * | 9/1971 | Read | 277/317 |
| 4,423,775 | A | * | 1/1984 | Wilson | 166/84.4 |
| 6,394,461 | B1 | * | 5/2002 | Henderson | 277/327 |

* cited by examiner

*Primary Examiner*—Frank S Tsay
(74) *Attorney, Agent, or Firm*—Timothy Donoughue; Keith R. Derrington

(57) ABSTRACT

The present invention discloses a well pressure activated pack off head comprising a hollow body formed for coaxial connection to the wellhead which provides for unobstructed passage of a data transmitting wireline therethrough. Disposed coaxially within the hollow body is a pack off rubber with a passage formed along its longitudinal axis for passage of a data transmitting wireline. Located below the pack off rubber is a piston in pressure communication with the wellbore. High pressure inside of the wellbore squeezes the piston against the pack off rubber and compresses it tightly around the wireline. A pressure seal is formed between the pack off rubber and the wireline when the pack off rubber is sufficiently compressed by the piston.

22 Claims, 3 Drawing Sheets

WELL PRESSURE ACTIVATED PACK-OFF HEAD

RELATED APPLICATIONS

This application is a divisional of co-pending application 09/841,671 now U.S. Pat. No. 6,588,502 and this application claims priority from co-pending U.S. Provisional Application No. 60/251,292, filed Dec. 5, 2000, the full disclosure of which is hereby incorporated by reference herein.

BACKGROUND OF THE INVENTION

1. Field of the Invention

The invention relates generally to the field of oil and gas well services. More specifically, the present invention relates to an apparatus that provides a pressure seal around a wireline during oil field service operations.

2. Description of Related Art

Numerous techniques, generally known as well logging, exist for collecting geological data from oil and/or gas wells, where the geological data is useful for locating potential hydrocarbon bearing reservoirs. Well logging is also used for estimating the capacity of the potential hydrocarbon bearing reservoirs. Many types of well logging practices exist. They include neutron logs, induction logs, and acoustic logs. In each of the aforementioned well logging techniques a well logging tool is deposited into the wellbore and travels through the well bore collecting geological data about the region surrounding the well bore. Generally the well logging tool produces a signal, either electrical, nuclear, or acoustical, which is directed into the area adjacent the well bore. The reflection or propagation of the emitted signal is then retrieved by the tool or by another piece of equipment suitably located. The retrieved signals are stored and analyzed in order to evaluate the potential for hydrocarbon production in the particular geological formation being analyzed, monitor reservoir performance, or to evaluate wellbore mechanical integrity.

Generally, the well logging tool is inserted into the well bore attached to a wireline. The tool is raised and lowered by the wireline, and data is transmitted through the wireline for introducing signals to the well logging tool from the surface. The wire line can also transmit data recovered from within the well bore to the surface for collection and analysis.

As a secondary safety measure, a pressure containment apparatus, or pack off head, is often installed on the well during wireline operations. Wireline (or slick-line) pack off heads (oil savers) have been used by the oil field service industry for many years. A pack off head is designed to make a pressure seal around a wireline to contain the well pressure during trips in and out of the well. If during wireline operations a well kick were experienced, an unsafe condition would occur if the well head was not contained but instead left open to atmosphere. A typical pack off head includes a hard rubber insert with a passage where the wire line passes through the annulus. To seal around the wireline, the hard rubber insert is axially compressed, which reduces the cross sectional area of the passage. Reducing the cross sectional area of the passage causes the inner radius of the passage to fit snugly around the outer radius of the wire line, thus preventing fluid flow through the passage. Although the passage snugly seals around the outer radius of the wire line, the wire line is still able to freely traverse through the passage.

Traditionally, pack off heads have been manual or hydraulic. A manual style pack off head is usually comprised of a threaded cap that compresses the rubber packing element as the cap is screwed down onto the head assembly. This operation is typically performed by hand. The hydraulic style pack off head has a hydraulic cylinder that is expanded via hydraulic pressure provided by a hand pump connected to the head by a hydraulic hose. The pack off head cylinder expands as pressure is supplied to it, expansion of the pack off head cylinder in turn compresses the pack off element. Both the manual and the hydraulic pack off heads compress a packing element to provide a seal around the wireline and both require personnel to perform this function.

Therefore, a method or an apparatus is desired that provides an automatic pressure sealing function around a wireline when the pack off head is located in an area that is not accessible to be either manually or hydraulically operated while a wireline is being lowered into and drawn from a hydrocarbon producing wellbore.

BRIEF SUMMARY OF THE INVENTION

One embodiment of the present invention discloses a well pressure activated pack off head to be used in conjunction with a wellhead situated on a hydrocarbon producing wellbore. The well pressure activated pack off head comprises a hollow body formed for coaxial connection to the wellhead, the hollow body must also provide for unobstructed passage of a data transmitting wireline therethrough.

Disposed within the hollow body is a pack off rubber with a passage formed along its longitudinal axis for passage of a data transmitting wireline therethrough The pack off rubber is coaxially situated within the hollow body. The pack off rubber can be formed from numerous materials, but the material must be pliable enough under the conditions of use to provide a pressure seal between it and the wireline passing through its axis.

Also located in the hollow body, above and proximate to the pack off rubber, is a pack off bushing. The pack off bushing is coaxial to the hollow body and has an axial passage formed along its axis to allow for passage of a data transmitting wireline through its axis. The pack off bushing should have a higher hardness than the pack off rubber, typical materials include brass or hard face steel.

The well pressure activated pack off head further includes a piston coaxially situated within the hollow body and also has an axial passage formed concentric along its axis that allows for passage of a data transmitting wireline through it. The bottom of the piston is its wellbore pressure side and its top is its ambient pressure side. The wellbore pressure side of the piston is in pressure communication with the wellbore. The ambient pressure side of the piston is in pressure communication with the ambient space surrounding the pressure pack off head. The piston is situated below the pack off rubber, which puts the pack off rubber between the piston and the pack off bushing.

When the pressure of the wellbore, and thus the wellbore pressure side, exceeds the ambient pressure, the pressure differential experienced by the piston urges it toward the pack off bushing and pack off rubber. Continued upward movement of the piston causes the piston to contact the pack off rubber and push the pack off rubber against the pack off bushing. This pushing action compresses the pack off rubber between the piston and the pack off bushing such that compression of the pack off rubber compresses the pack off rubber axial passage around the data transmitting wireline. Compression of the pack off rubber axial passage around the data transmitting wireline eventually provides a pressure seal between the pack off rubber axial passage and the data transmitting wireline passing therethrough. The well pressure activated pack off head can also include a rubber compressor disposed between the piston and the pack off rubber, the rubber compressor transmits the axial compressing force from the piston to the pack off rubber.

To prevent pressure spikes in the wellbore from causing transient high forces upon the pack off rubber, the pressure pack off head includes a pressure regulator that controls the pressure between the wellbore and the piston. One example of a pressure regulator is a restriction orifice that regulates the pressure differential across the piston which limits the maximum force that the piston can apply to the pack off rubber (or the rubber compressor).

Also included in the well pressure activated pack off head is a spring that urges the piston away from said pack off rubber when the spring force exceeds the force experienced by the piston resulting from the pressure differential across its two sides. The size, configuration, and material of the spring is based on the application of the well pressure activated pack off head.

An alternative embodiment of the well pressure activated pack off head also includes a hollow body, a piston, a pack off rubber, and a pack off bushing axially situated in the hollow body. Here the piston has a wellbore pressure side and an ambient side. Also included in this alternative is a hydraulic piston and a means for communicating pressure from the ambient pressure side of the piston to the hydraulic piston.

Within the pressure communication means is a pressure regulator that controls the pressure that is delivered to the hydraulic piston from the ambient pressure side of the piston. As in the first embodiment, the pressure control means limits pressure excursions experienced in the wellbore from exerting high compression forces onto the pack off rubber.

Like the first embodiment, the alternative embodiment operates on the principal that the wellbore pressure will exceed the ambient pressure around the pack off head. The pressure differential is then utilized to produce a force that compresses the hydraulic piston against the pack off rubber, this squeezes the pack off rubber around the data transmitting wireling to provides a pressure seal around the pack off rubber and the data transmitting wireline. Also included in the alternative embodiment of the well pressure activated pack off head is a spring axially provided in the hollow body situated to urge the hydraulic piston away from the pack off rubber when the force experienced by the pressure differential across the hydraulic piston is lower than the spring force.

A third embodiment of a well pressure activated pack off head also comprises a hollow body, a pack off rubber, a pack off bushing, and a piston axially located in the hollow body. Like the other embodiments, these components are all formed to allow free passage of a wireline along their axis.

The piston has a top side, a bottom side, and a shaft connecting the piston top side to a rubber compressor. The piston bottom side is in pressure communication with the wellbore, and the pack off rubber is situated between said pack off bushing and said rubber compressor.

Like the other embodiments, this embodiment works on the principal of a force resulting from a pressure differential across an object. Because the wellbore pressure will generally exceed the ambient pressure around the well pressure activated pack off head, those two pressures are disposed across opposite faces of an object to produce a force, here the object is the piston. The resulting force across the piston is used to compress the pack off rubber against the pack off bushing. A compressed pack off rubber will result in a pressure seal between it and a data transmitting wireline passing through the axial passage of the pack off rubber.

DETAILED DESCRIPTION OF THE INVENTION

Figure 1:
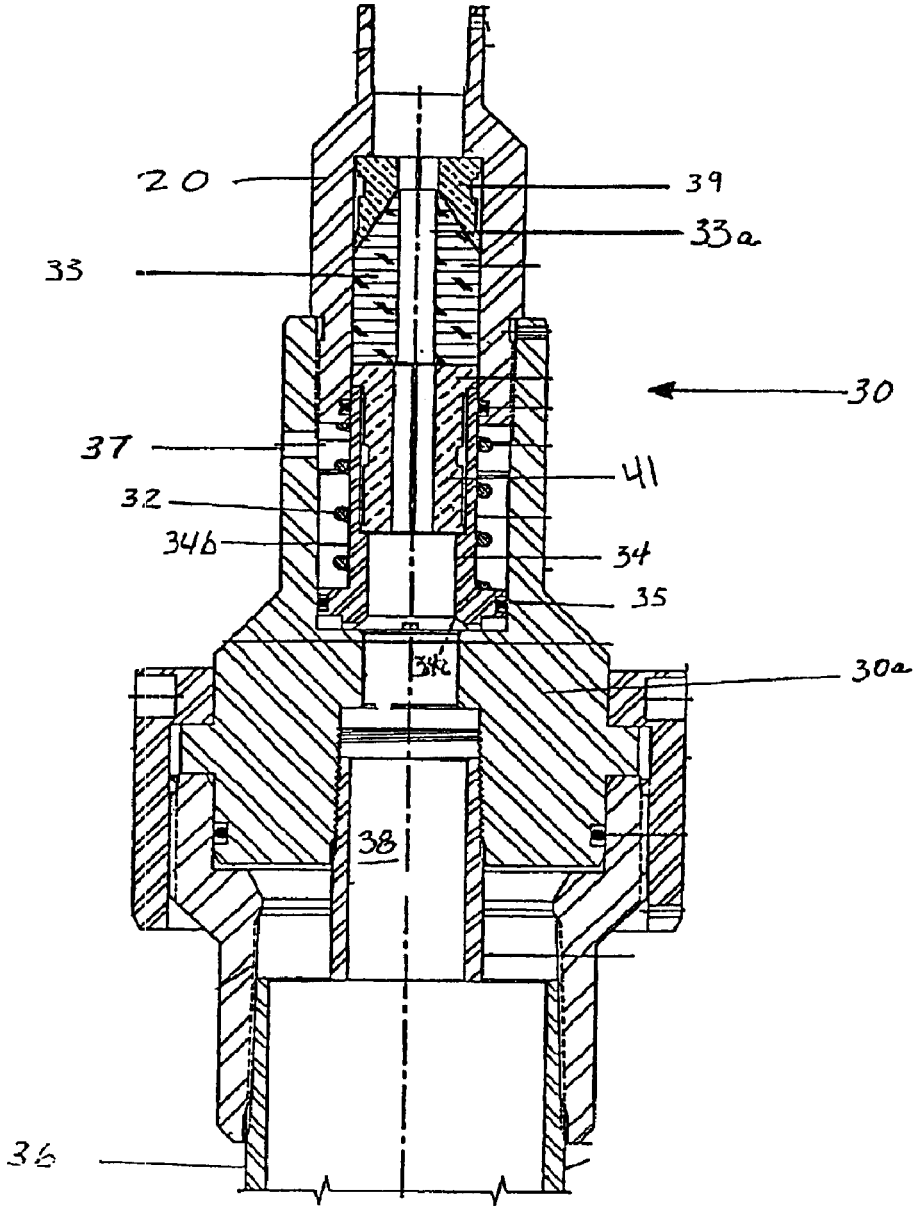
FIG. 1 illustrates a cross section of the well pressure activated pack off head.

With reference to the drawing herein, a Well Pressure Activated Pack Off Head 30 according to one embodiment of the invention is shown in FIG. 1. The cross-sectional view of FIG. 1 illustrates that the Well Pressure Activated Pack Off Head 30 includes a pack off bushing 39, a pack off rubber 33, a pressure port 37, a spring 32, a rubber compressor 41, a hollow body 20, and a piston 34. Each component of the Well Pressure Activated Pack Off Head 30 should contain an axial passage suitable for passage of a well logging wireline 15 through the Well Pressure Activated Pack Off Head 30. To ensure that the pack off rubber 33 properly seals around a wireline 15, it is important that the pack off rubber 33 material be sufficiently pliable to perform under the extreme cold or hot conditions for which it will be used, and yet be of adequate resiliency to sustain the pressure applied to it to preclude leakage between the pack off rubber 33 and the wireline 15.

Use of the Well Pressure Activated Pack Off Head 30 is not limited to traditional grade or sea surface oil and/or gas wells but can also be used with subsea applications and other applications where the well head is in an inaccessible or difficult to monitor location. Utilization of the Well Pressure Activated Pack Off Head 30 in place of prior art pack off heads eliminates the need to constantly monitor and adjust the sealing force of the pack off rubber of these prior art pack off heads. Further, the Well Pressure Activated Pack Off Head 30, when used during any wireline operation, such as well logging, well perforating, or mechanical services, is capable of providing safety measures in a well where the wellbore pressure exceeds the pressure of the surrounding formation.

One of the advantages of the present invention is that an automated pressure seal can be provided around the wireline 15 at the wellbore entrance. Because the pressure seal is automated, the risk of human error during operations is reduced. Also reduced are the resources of added personnel required to monitor and adjust a manually operated pack off head. During wireline operations, gas bubbles from hydrocarbons entrained in the wellbore, and adjacent formations, can begin to form beneath the wireline tool as the tool is traversed through the wellbore If enough gas bubbles form below the wireline tool, the buoyancy provided by the gas bubbles can exert an upward force onto the tool which in turn attempts to eject the tool from the wellbore. This is known as a "well kick". Well kicks can be detected by the well operators at the surface by monitoring the fluids that are exiting the wellbore.

If well operators determine that a well kick is imminent, they can actuate the rams provided on a well blow out preventer (not shown). If the situation is determined to be severe enough, a shear ram will be actuated which will shear whatever is inserted through the wellbore, either the wireline 15 or a drill string. Shearing the wireline 15 will allow whatever is located in the wellbore beneath the shear ram to fall deep into the wellbore, which can terminate hydrocarbon production from the wellbore, this is an undesireable result. Other undesireable effects of using shear rams include leaving expensive well logging tools in a wellbore, some of which are radioactive, and wireline 15 becoming entangled with drill pipe. Implementation of the Well Pressure Activated Pack Off Head 30 can seal the well during some well kicks and therefore eliminate the need to immediately suspend well operations.

The Well Pressure Activated Pack Off Head is generally attached to a wellbore by threaded attachment of the coupling 36. This provides pressure communication between the pack off head passage 38 and the wellbore, which in turn puts the piston wellbore side 34*a* in pressure communication with the well bore as well. The pressure port 37 provides pressure communication between the piston spring side 34*b* and the ambient conditions experienced by the Well Pressure Activated Pack Off Head 30. In surface operations this will be atmospheric pressure, in subsea applications the ambient pressure will be the pressure at the sea floor. Accordingly, when the wellbore pressure exceeds ambient pressure, a pressure differential will exist across the piston 34. This pressure differential produces a resultant force which pushes the piston 34 upwards against the rubber compressor 41. When the rubber compressor 41 is pushed upward by the piston 34, the rubber compressor 41 will compress the pack off rubber 33 against the pack off bushing 39. This reduces the cross sectional area of the rubber inner passage 33*a* and squeezes the rubber inner passage 33*a* tightly around the wireline 15, thus providing a seal to prevent leakage across the pack off rubber 33. Leakage between the outer radius of the piston 34 and the inner passage of the pressure pack off head body 30*a* is prevented by a piston seal 35. Although the pack off rubber 33 is sealingly engaged tightly around the wireline 15, the wireline 15 must still able to freely transverse through the pack off head passage 38.

Because of the wear experienced by the pack off bushing 39 and the rubber compressor 41, it is preferred they be formed from a material that can withstand repeated traversals of wireline 15 through their axis without experienced undue wear. Suitable materials would include either brass or hard faced steel. However, the operating environment in which the well pressure activated pack off head is exposed to will also be a factor in deciding exactly which material to use for these components.

During wireline operations the rubber inner passage 33*a* will experience some wear. Although the wear will result in material loss of the inner annulus of the pack off rubber 33, the pack off rubber 33 will continue to seal against the wireline 15 because of the constant compressive force applied to it by the rubber compressor 41. When the piston wellbore side 34*a* is no longer exposed to the borehole pressure, or the borehole pressure is sufficiently decreased below the spring force of the spring 32, the spring 32 will return the piston 34 to its original position against the pressure pack off head body 30*a*. The dimensions and characteristics of the spring 32 are determined based on the well parameters. When the spring 32 moves the piston 34 away from the rubber compressor 41, the rubber compressor 41 will cease to apply force to the pack off rubber 33, and therefore no longer compress it.

The cross sectional area of the pressure port 37 can be adjusted to regulate the fluid flow from the ambient pressure side of the piston 34 to the ambient space surrounding the Well Activated Pressure Pack Off Head 30. The cross sectional area of the pressure port 37 can be enlarged by drilling a larger aperture, or can be reduced by adding a restriction orifice 37*a* or a ferrel. Regulating the fluid flow exiting the pressure port 37, and more specifically limiting this flow, will dampen the upward movement and impulse force that the piston 34 applies to the pack off rubber 33. It is desired to not allow pressure spikes onto the pack off rubber 33 as this can cause episodes of increased squeezing force onto the wireline 15, which can damage it.

Figure 2:
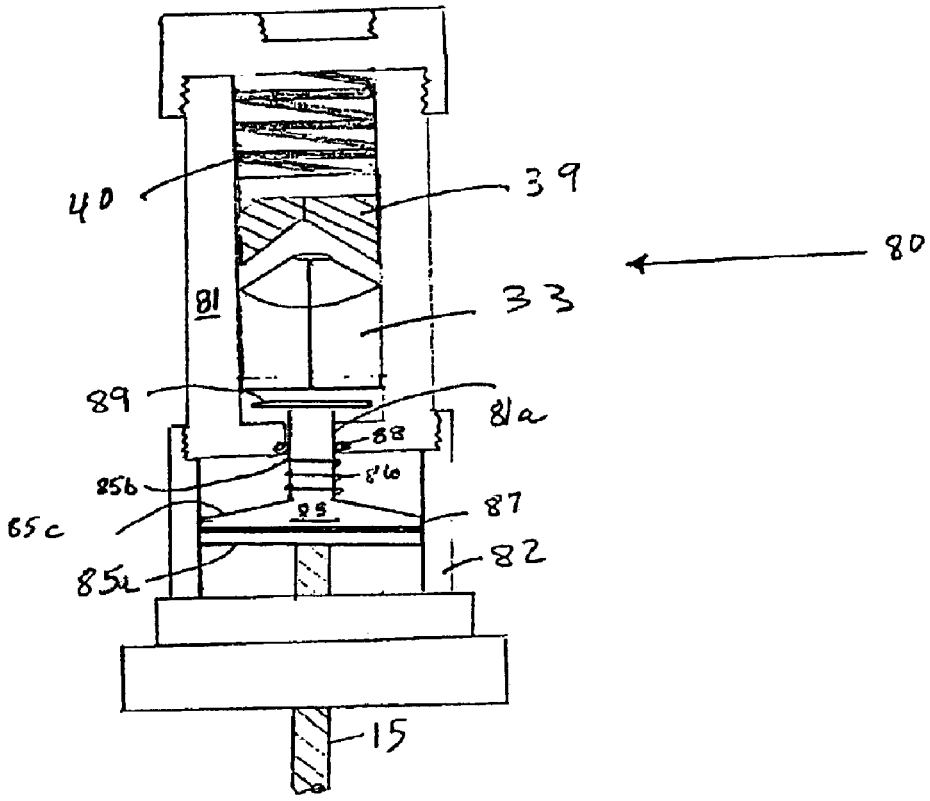
FIG. 2 shows a cross section of an alternative embodiment of the well pressure activated pack off head.

In FIG. 2, one alternative embodiment of the Well Pressure Activated Pack Off Head 80 is depicted. This embodiment also implements a pack off head upper body 81, a pack off head lower body 82, a piston 85, a pack off rubber 33, a pack off bushing 39, and a bushing spring 40. In this embodiment of the Well Pressure Activated Pack Off Head 80, the piston 85 includes a piston bottom 85*a* and piston shaft 85*b*. Attached to the top of the piston shaft 85*b* is an alternative embodiment of the rubber compressor 89, and provided on the piston shaft 85*b* is a piston spring 86. The piston shaft 85*b* is formed to fit within an aperture 81*a* formed concentrically on the bottom of the pack off head upper body 81.

Because the piston bottom 85*a* is in pressure communication with the wellbore the piston 85 will be forced upward when the wellbore pressure is greater than the pressure at the piston top side 85*c*. Continued upward movement of the piston 85 causes the rubber compressor 89 to impinge the pack off rubber 33 against the pack off bushing 39 and squeeze the inner radius of the pack off rubber 33 against the wireline 15. Here, the bushing spring 40 will be compressed when the pack off rubber 33 is squeezed against the pack off bushing 39, and will expand to its original configuration when the spring force of the bushing spring 40 surpasses the force applied by the piston 85 due to wellbore pressure. Similarly, when upward force supplied to the piston 85 by the wellbore pressure is less than the spring force of the piston spring 86, the piston spring 86 will expand and push the piston 85 away from the pack off rubber 33.

To prevent pressure communication across the piston 85, a piston head seal 87 is provided to provide a sealing function between the piston 85 and the inner surface of the pack off head lower body 82. The piston shaft seal 88, situated between the piston shaft 85*b* and the pack off head upper body 81, provides a pressure seal between the piston top side 85*c* and the aperture 81*a*.

Figure 3:
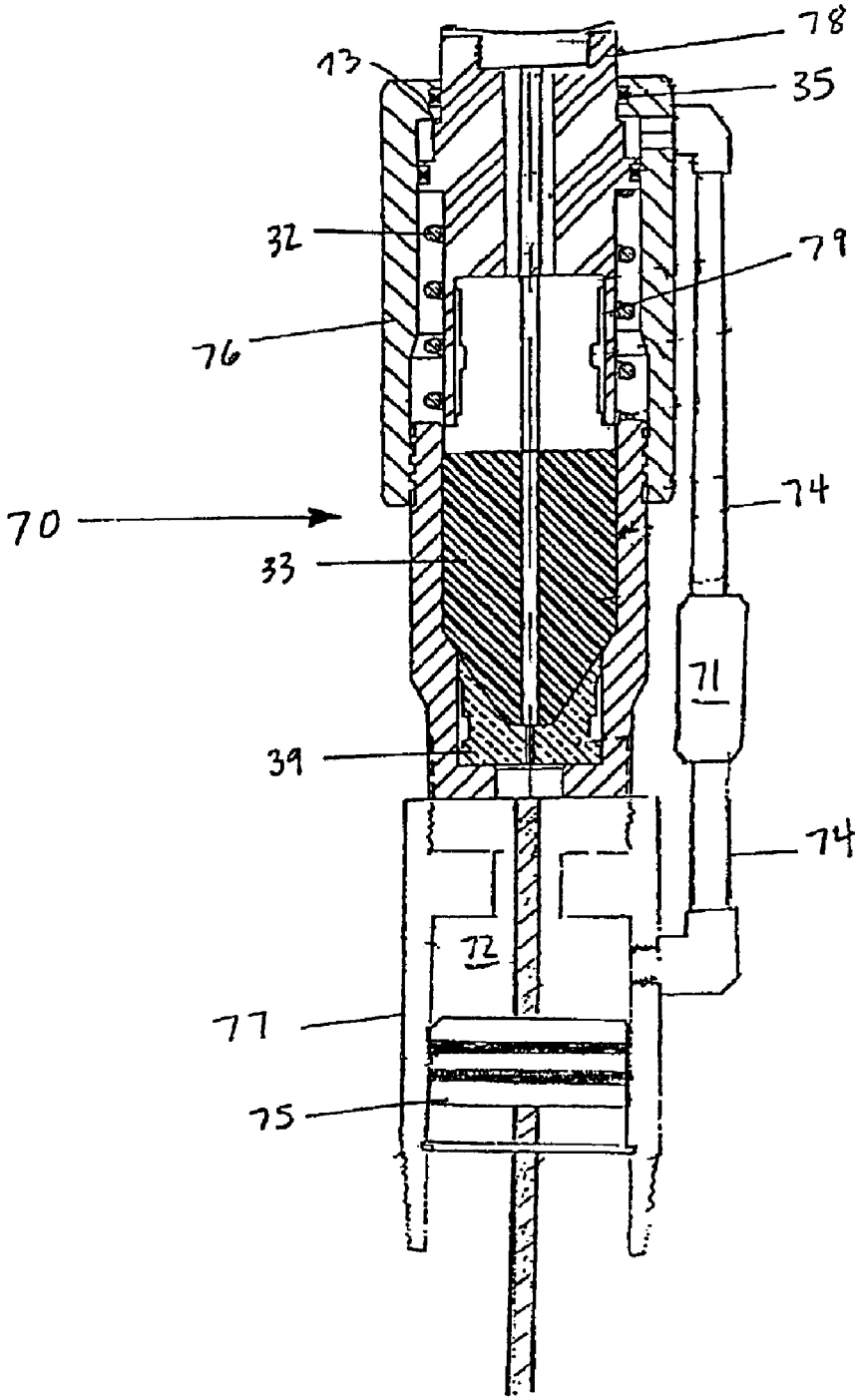
FIG. 3 depicts yet another alternate embodiment of the well pressure activated pack off head.

FIG. 3 depicts yet another embodiment of the Well Pressure Activated Pack Off Head 70. The Well Pressure Activated Pack Off Head 70 includes a hydraulic piston 75, a compression piston 78, a rubber compressor 79, a spring 32, an annulus 73, tubing 74, a pressure regulator 71, a pack off head upper body 76, a pack off head lower body 77, a pack off bushing 39, a pack off rubber 33, and a reservoir 72. In this embodiment, the bottom of the hydraulic piston 75 is exposed to the wellbore pressure, so that when the pressure of the wellbore is different than the pressure of the reservoir 72 , the hydraulic piston 75 will experience a pressure gradient across its body. Further, when the pressure gradient results in an upward force that overcomes the static friction of the hydraulic piston 75, the hydraulic piston 75 will move upward.

The reservoir 72 is filled either with a fluid, including a gas (such as air or nitrogen), hydraulic fluid, or grease. When the hydraulic piston 75 (which is situated in the pack off head lower body 77) is moved upward the volume of the reservoir 72 is decreased, which forces some of the contents of the reservoir 72 into the tubing 74. The fluid contents of the reservoir 72 that enters the tubing 74 is directed into the annulus 73, which in turn increases the pressure of the annulus 73. Situated on the tubing 74, the pressure regulator 71 controls the pressure of the fluid flow into the annulus 73.

When the pressure in the annulus 73 (as supplied via the tubing 74) exceeds the spring force of the spring 32, the compression piston 78 moves downward and pushes the rubber compressor 79 against the pack off rubber 33. Continued movement of the rubber compressor 79 against the pack off rubber 33 ultimately squeezes the pack off rubber 33 against the pack off bushing 39, this reduces the inner radius of the pack off rubber 33 and results in a seal against the wireline 15. The pack off rubber 33 will continue to provide a seal along the wireline 15 until the force applied to the compression piston 78 by the annulus pressure is less than the spring force of the spring 32.

The pressure regulator 71 works the same as a pressure control valve. The purpose of the pressure regulator 71 is to provide a constant supply of pressure to the compression piston 78, this eliminates high pressure excursions experienced by the well bore from acting on the compression piston 78. If the compression piston 78 is exposed to sudden episodes of high pressure, it will then translate the pressure to a sudden high force onto the rubber compressor 79 and ultimately the pack off rubber 33. Sudden high forces applied to the pack off rubber 33 by the rubber compressor 79 will in turn cause the pack off rubber 33 to squeeze the wireline 15 such that the wireline 15 can be damaged.

The present invention described herein, therefore, is well adapted to carry out the objects and attain the ends and advantages mentioned, as well as others inherent therein. While a presently preferred embodiment of the invention has been given for purposes of disclosure, numerous changes in the details of procedures for accomplishing the desired results. For example the invention can be used as an additional safety measure for any wireline procedure, such as perforations and plug setting, These and other similar modifications will readily suggest themselves to those skilled in the art, and are intended to be encompassed within the spirit of the present invention disclosed herein and the scope of the appended claims.

What is claimed is:

1. A well pressure activated pack off head comprising:

a hollow body;

pack off element being coaxially situated within said hollow body;

a pack off bushing;

a hydraulic piston coaxially located within said well pressure activated pack off head, said hydraulic piston having a wellbore pressure side and a hydraulic reservoir pressure side;

wherein said hydraulic piston wellbore pressure side is in pressure communication with the wellbore;

a hydraulic reservoir in pressure communication with the hydraulic reservoir pressure side of said piston;

a compression piston having an upper portion and a lower portion coaxially located within said hollow body;

wherein said pack off element is situated between said pack off bushing and the lower portion of said compression piston; and wherein said hydraulic reservoir and the upper portion of said compression piston are in pressure communication.

2. The well pressure activated pack off head of claim 1 wherein said piston is responsive to the wellbore pressure and is urged into said hydraulic reservoir when the wellbore pressure is greater than the hydraulic reservoir pressure.

3. The well pressure activated pack off head of claim 1 further comprising a wireline disposed through said pack off element wherein a pressure seal is created between said pack off element and the wireline.

4. The well pressure activated pack off head of claim 1, further comprising a pack off bushing, wherein said hollow body is comprised of an upper chamber and a lower chamber, said lower chamber housing said piston and said hydraulic reservoir, and said upper chamber housing said hydraulic piston, said pack off bushing and said pack off element.

5. The well pressure activated pack off head of claim 1 further comprising an axial passage provided through said compression piston formed for passage of a line.

6. The well pressure activated pack off head of claim 1 further comprising an annular recess formed along the upper portion of said compression piston.

7. The well pressure activated pack off head of claim 1 further comprising a pack off bushing disposed within said hollow body.

8. The well pressure activated pack off head of claim 7 wherein said pack off element is disposed between said pack off bushing and said compression piston.

9. The well pressure activated pack off head of claim 1 further comprising a spring axially disposed within said hollow body situated to urge said hydraulic piston away from said pack off element.

10. A well pressure activated pack off head to be used with a wellbore comprising:

an upper body having a cavity formed along its length within said upper body, said upper body cavity circumscribed by an upper body wall;

a lower body coaxially disposed adjacent said upper body, said lower body having a cavity formed along its length circumscribed by a lower body wall;

a compression piston coaxially housed within said upper body cavity, said compression piston having a wellbore pressure side and an ambient pressure side;

a reservoir disposed within said lower body cavity, wherein said reservoir is responsive to the pressure within the wellbore and wherein said upper body cavity is in pressure communication with said reservoir; and a pack off element coaxially disposed within said upper body.

11. The well pressure activated pack off head of claim 10, further comprising an aperture coaxially formed through said compression piston and said pack off element providing passage of a wireline to be disposed therethrough and a wireline inserted through said aperture.

12. The well pressure activated pack off head of claim 10, further comprising an upper body port formed through said upper body wall, a lower body port formed through the lower body wall, and tubing connected on one end to said upper body port and connected on its other end to said lower body port, thereby providing pressure communication between said reservoir and said upper body cavity.

13. The well pressure activated pack off head of claim 12, further comprising a pressure regulator disposed in said tubing.

14. The well pressure activated pack off head of claim 10, wherein said compression piston comprises a bottom end, a top end, and a recessed portion proximate to said top end that extends along a length of said compression piston, wherein an annulus is formed between said recessed portion and the inner wall of said upper body.

15. The well pressure activated pack off head of claim 10, further comprising a bushing coaxially disposed within said upper body cavity such that said pack off element is located between said compression piston and said bushing, and said pack off element is located on the ambient pressure side of said compression piston.

16. The well pressure activated pack off head of claim 10, further comprising an aperture coaxially formed within said piston and said pack off element, said aperture providing for the passage of a wireline to be disposed therethrough, a wireline inserted through said aperture, a bushing situated within said upper body cavity such that said pack off element is between said compression piston and said bushing and said pack off element is located on the ambient pressure side of said compression piston, wherein said compression piston is urged towards said pack off element and compresses said pack off element against said bushing thereby contracting said aperture within said pack off element to provide a sealing engagement across the wireline where the wireline passes through the aperture formed in said pack off head.

17. The well pressure activated pack off head of claim 16, wherein said compression piston is urged towards said pack off element in response to a pressure differential between said well pressure side and said ambient pressure side.

18. The well pressure activated pack off head of claim 17, further comprising tubing, wherein the pressure differential between said well pressure side and said ambient pressure side is substantially produced by the pressure within the wellbore being communicated to said well pressure side via said tubing and said reservoir.

19. The well pressure activated pack off head of claim 10 further comprising a hydraulic piston axially disposed within said lower body cavity.

20. The well pressure activated pack off head of claim 19, wherein said hydraulic piston has a first side and a second side, where said first side is in pressure communication with said well pressure side of said compression piston and said second side is in pressure communication with the wellbore.

21. The well pressure activated pack off head of claim 20, further comprising an upper body port formed through said upper body wall, a lower body port formed through the lower body wall, and tubing connected on one end to said upper body port and connected on its other end to said lower body port, thereby providing pressure communication between said first side of said hydraulic piston and said well pressure side of said compression piston.

22. The well pressure activated pack off head of claim 21, further comprising an aperture coaxially formed within said hydraulic piston and said pack off element, said aperture providing passage of a wireline to be disposed therethrough, a wireline inserted through said aperture, a bushing situated within said upper body cavity such that said pack off element is between said hydraulic piston and said bushing and said pack off element is located on the ambient pressure side of said compression piston, wherein said compression piston is urged towards said pack off element and compresses said pack off element against said bushing thereby contracting said aperture within said pack off element to provide a sealing engagement across the wireline where the wireline passes through the aperture formed in said pack off head.

* * * * *